US008596087B2

(12) United States Patent
Park

(10) Patent No.: US 8,596,087 B2
(45) Date of Patent: Dec. 3, 2013

(54) REFRIGERATOR

(75) Inventor: Hee Uhk Park, Changwon (KR)

(73) Assignee: LG Electronics Inc., Seoul (KR)

( * ) Notice: Subject to any disclaimer, the term of this patent is extended or adjusted under 35 U.S.C. 154(b) by 1027 days.

(21) Appl. No.: 12/634,521

(22) Filed: Dec. 9, 2009

(65) Prior Publication Data

US 2010/0175416 A1 Jul. 15, 2010

Related U.S. Application Data

(60) Provisional application No. 61/145,033, filed on Jan. 15, 2009.

(51) Int. Cl.
*F25D 3/00* (2006.01)

(52) U.S. Cl.
USPC ..... 62/389; 620/440

(58) Field of Classification Search
USPC ..... 62/389, 344, 338, 440, 449; 222/146.6, 222/142.3; 312/401, 405.1
See application file for complete search history.

(56) References Cited

U.S. PATENT DOCUMENTS

| | | | | |
|---|---|---|---|---|
| 7,269,968 | B2 * | 9/2007 | Harder et al. | 62/389 |
| 7,343,757 | B2 * | 3/2008 | Egan et al. | 62/389 |
| 7,416,097 | B2 * | 8/2008 | Crisp et al. | 222/399 |
| 7,603,869 | B2 * | 10/2009 | Kim et al. | 62/129 |
| 7,681,406 | B2 * | 3/2010 | Cushman et al. | 62/72 |
| 2006/0196892 | A1 * | 9/2006 | Crisp et al. | 222/399 |

* cited by examiner

*Primary Examiner* — Mohammad M Ali
(74) *Attorney, Agent, or Firm* — Birch, Stewart, Kolasch & Birch, LLP

(57) ABSTRACT

Provided is a refrigerator. The refrigerator includes a refrigerator main body and a refrigerator door. A dispenser for dispensing at least water and a storage box in which a specific material for adding fragrance or taste to the water is received are provided in the refrigerator main body or the refrigerator door.

16 Claims, 8 Drawing Sheets

REFRIGERATOR

This Non-Provisional application claims priority under 35 U.S.C. 119(e) on U.S. Provisional Application No. 61/145,033, filed on Jan. 15, 2009, the entire contents of which are hereby incorporated by reference.

BACKGROUND

Embodiments relate to a refrigerator.

Generally, a refrigerator is an appliance that can store foods at a low temperature using cool air supplied into a storage compartment.

The refrigerator includes a dispenser connected to a water tank or a water pipe. The dispenser may be disposed on a refrigerator door or inside a main body of a refrigerator. The dispenser may include a lever or a button for dispensing cold water or hot water using pressurization of the outside. Thus, when a user presses the lever or the button, the cold water or the hot water is discharged through the dispenser to dispense the cold water or the hot water.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
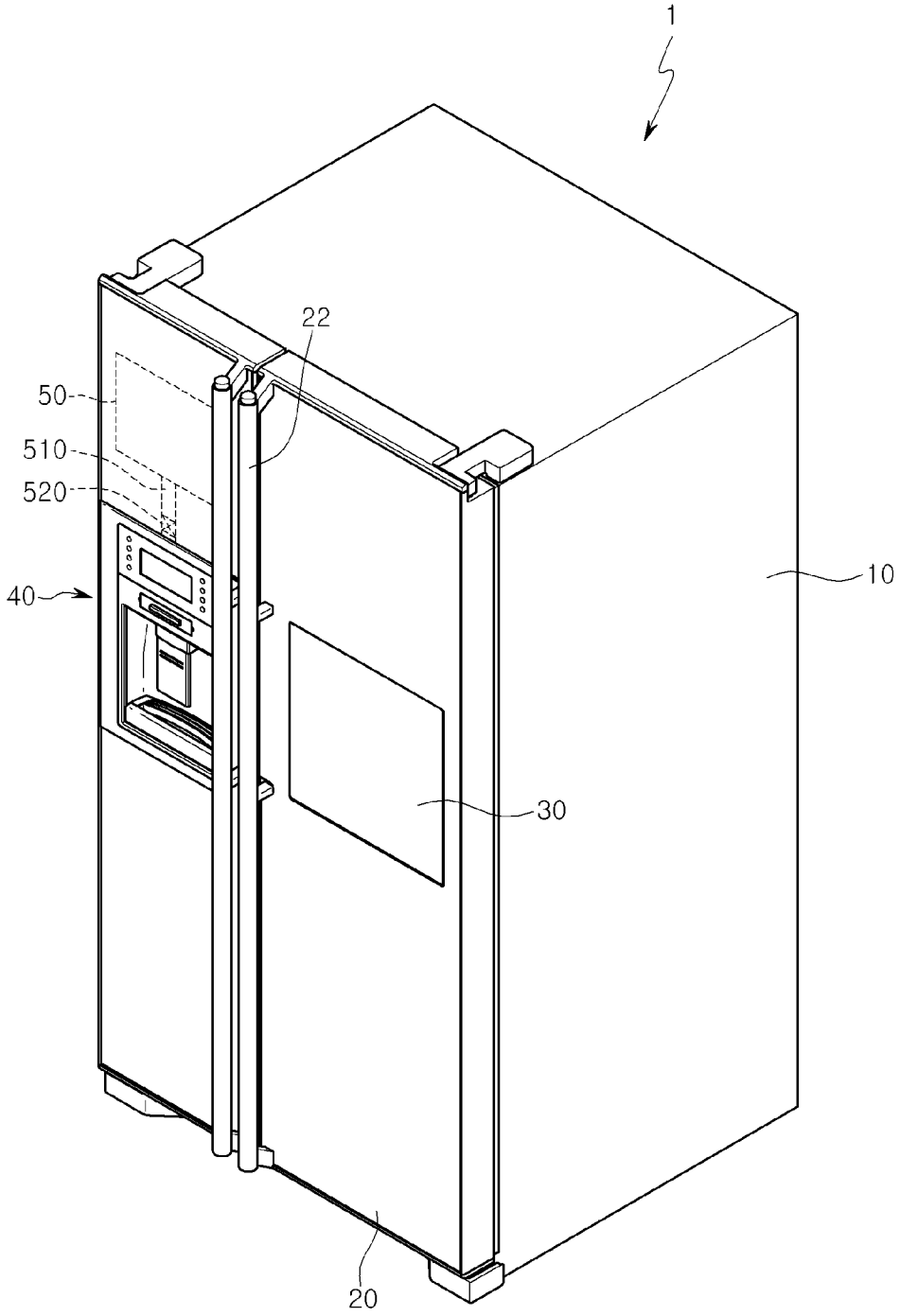
FIG. 1 is a perspective view of a refrigerator according to a first embodiment.

FIG. 1 is a perspective view of a refrigerator according to a first embodiment.

Although a side by side type refrigerator in which a refrigerator compartment and a freezer compartment are respectively disposed in left and right sides is illustrated in FIG. 1 as an example, the present disclosure is not limited thereto. For example, a refrigerator according to this embodiment may be applied to following various refrigerators: a top mount type refrigerator in which a refrigerator compartment is disposed under a freezer compartment; a bottom freezer type refrigerator in which a refrigerator compartment is disposed above a freezer compartment; and a refrigeration or freezing equipment provided with any one of a refrigerator compartment and a freezer compartment.

Referring to FIG. 1, a refrigerator 1 according to this embodiment includes a main body 10 defining a storage compartment and a door 20 coupled to the main body 10 to open or close the storage compartment. The door 20 is rotatably coupled to the main body 10 using a hinge (not shown). A handle 22 is disposed on the door 20.

For example, the storage compartment includes at least one of a freezer compartment and a refrigerator compartment, and the door 20 includes at least one of a freezer compartment door and a refrigerator compartment door.

A home bar 30 for withdrawing foods to the outside without opening the door 20 may be provided in the door 20. Articles such as drinking water or toiletries may be stored in the home bar 30.

A dispenser 40 for dispensing at least water to the outside of the door 20 is provided in the door 20. The dispenser may be connected to a water tank 50 or a water pipe (not shown).

Referring to FIG. 1, the dispenser 40 is connected to the water tank 50 as an example. The water tank 50 may be separably installed on the door 20. Also, the water tank 50 may be connected to the water pipe (not shown) in a state where the water tank 50 is installed on the door 20.

The water tank 50 is connected to a connection passage 510. A valve 520 for opening or closing the connection passage 510 is provided in the connection passage 510.

Figure 2:
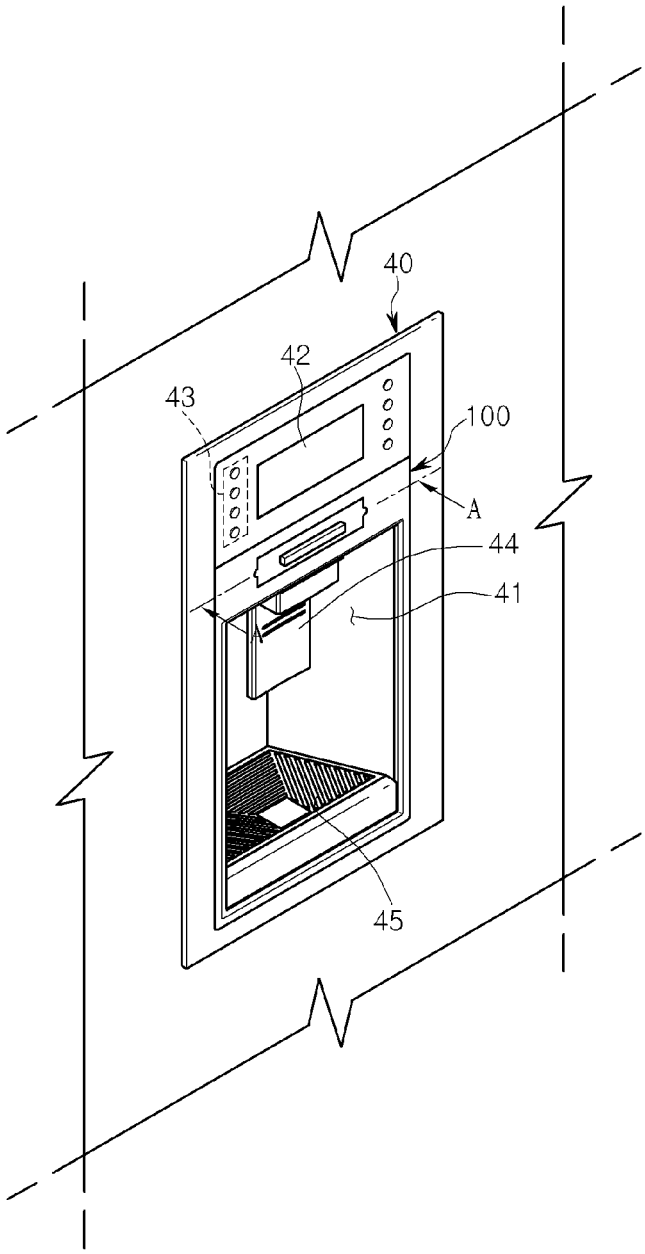
FIG. 2 is a perspective view illustrating a structure of a dispenser according to a first embodiment.
Figure 3:
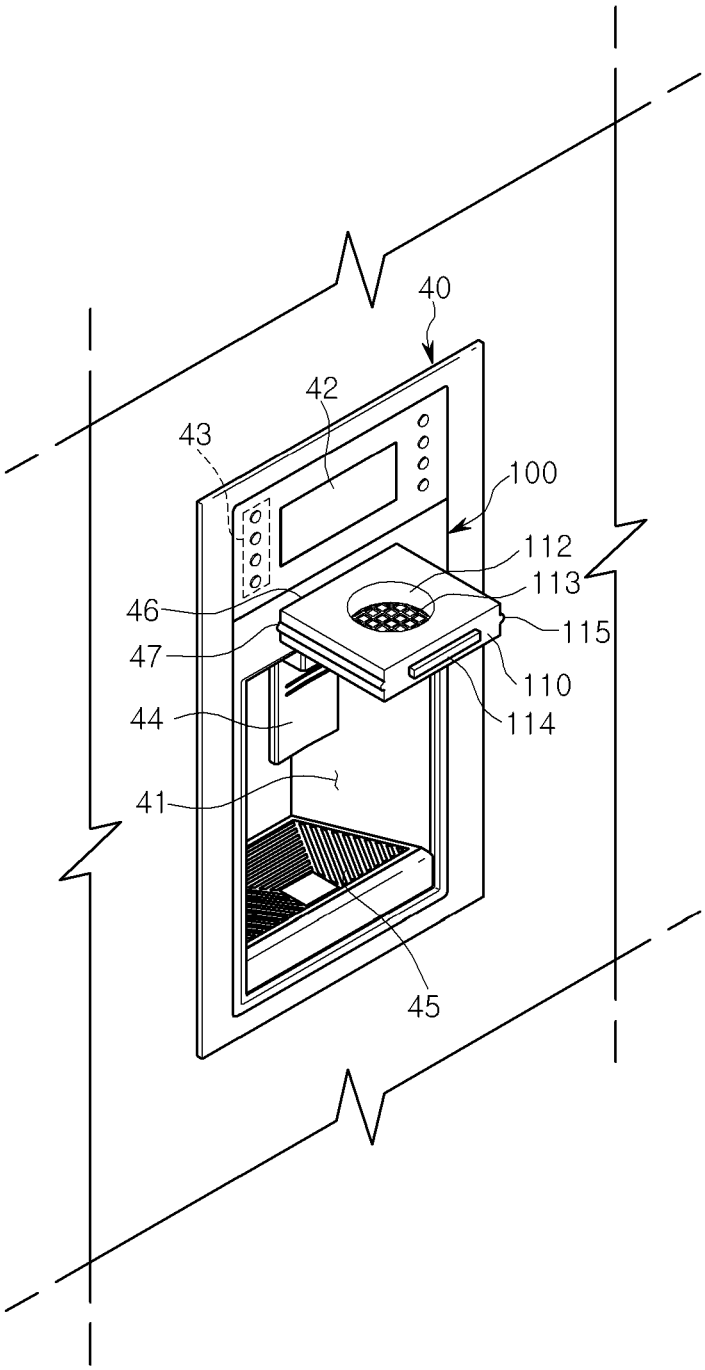
FIG. 3 is a perspective view of a dispenser in which a storage box is withdrawn according to a first embodiment.
Figure 4:
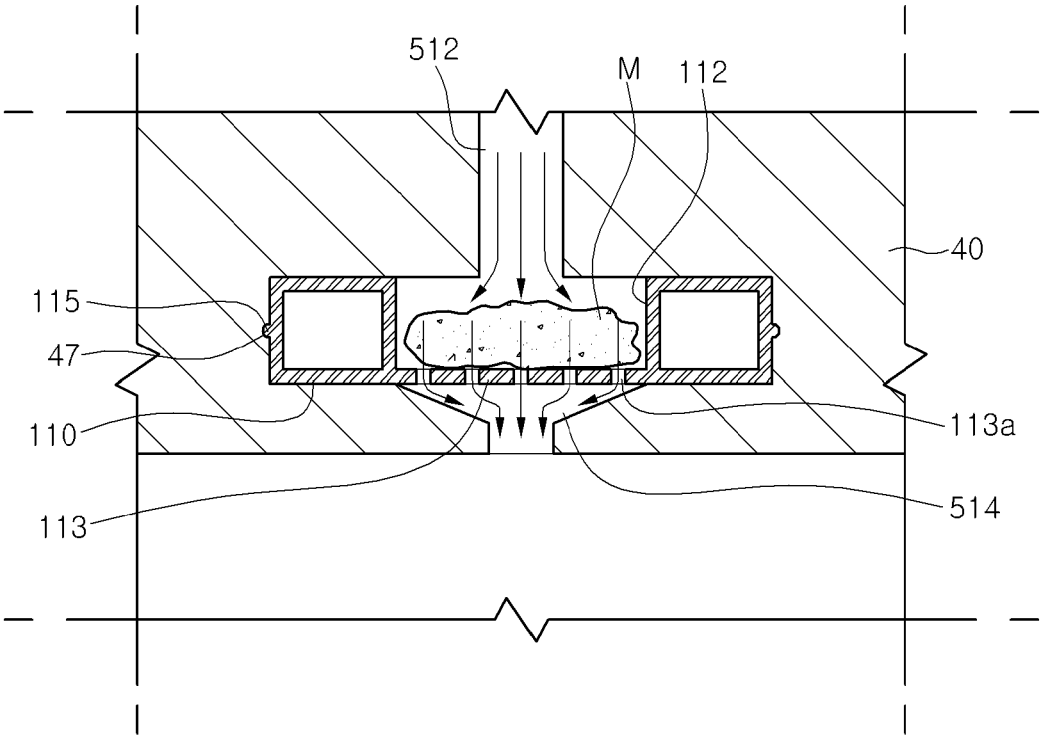
FIG. 4 is a cross-sectional view taken along line A-A of FIG. 2 according to a first embodiment.

FIG. 2 is a perspective view illustrating a structure of a dispenser according to a first embodiment, FIG. 3 is a perspective view of a dispenser in which a storage box is withdrawn according to a first embodiment, and FIG. 4 is a cross-sectional view taken along line A-A of FIG. 2 according to a first embodiment.

Referring to FIGS. 1 to 4, the dispenser 40 includes a receiving part 41 for receiving a container such as a cup. A front surface of the door 20 is depressed inwardly to define the receiving part 41.

A display part 42 for displaying an operation state of the dispenser 40 and an input part 43 for inputting an operation of the refrigerator 1 or an operation condition of the dispenser 40 are provided above the receiving part 41.

A storage box 100 selectively disposed on the connection passage 510 and receiving materials that adds specific fragrance or taste to water discharged to the outside is provided in the dispenser 40.

The storage box 100 is insertable and withdrawable into/from the dispenser 40 in front and rear directions of the door 20.

In detail, the input part 43 may include a plurality of buttons.

The plurality of buttons includes a temperature select button for selecting a temperature of at least water (cold water or hot water) and a taste select button for displaying the materials stored in the storage box 100 to the display part 43. The taste select button can select a type of the fragrance (or the taste) and add the type of the fragrance (or the taste).

For example, the materials stored in the storage box 100 may include coffee, tea, and cocoa. The materials may have a powder shape or include a bag receiving a raw material having powder shape and having micro pores.

Thus, according to the manipulation of the taste select button, the display part 42 may select the type of the fragrance or the taste added to the water, e.g., the coffee, the tea, and the cocoa to display the selected type of the fragrance or the taste.

The dispenser 40 includes a manipulation lever 40 for dispensing the water by a user's manipulation. The manipulation lever 40 protrudes toward the receiving part 41.

When the manipulation lever 44 is pressurized, a sensor (not shown) detects the pressurized manipulation lever 44 to transmit information with respect to the pressurized manipulation lever 44 to a control part (not shown). The control part opens the valve 520 according to the information transmitted from the sensor.

The dispenser 40 includes a prop part 45 on which the container is disposed. The prop part 45 is disposed below the manipulation lever 44 to support the container during the dispensing of the water.

A receiving chamber 46 for receiving the storage box 100 is defined in the dispenser 40. The storage box 100 is slidable within the receiving chamber 46 in front and rear directions.

The storage box 100 includes a housing 110 in which a receiving part 112 for receiving the materials is disposed.

The housing 110 includes a support 113 for supporting the materials received in the receiving part 112. A plurality of holes 113*a* through which the water passes may be defined in the support 113. Each of the holes 113*a* may have a size less than that of the powder to support the power in case where the materials have the powder shape.

Although the support 113 and the housing 110 are integrally formed in one body in this embodiment, the support 113, the present disclosure is not limited thereto. For example, the support 113 may be separated from the housing 110 to form a separate component, and then, may be coupled to the housing 110. In case where the support 113 is separately formed from the housing 110, the support 113 may be separated from the housing 110 to clean the support 113.

The handle 114 to be grasped by the user protrudes from a front surface of the housing 110. A guide protrusion 115 for guiding a movement of the housing 110 is disposed on a lateral surface of the housing 110. The guide protrusion 115 is disposed horizontally in front and rear directions of the housing 110. A protrusion insertion groove 47 in which the guide protrusion 115 is inserted is disposed in a wall defining the receiving chamber 46 of the dispenser 40.

Alternatively, the guide protrusion 115 may be disposed on the wall defining the receiving chamber 46, and the protrusion insertion groove 47 may be disposed in the housing 110.

Thus, a state in which the guide protrusion 115 or the protrusion insertion groove 47 is disposed on/in the wall defining the receiving chamber 46 is referred to as a first guide part, and a state in which the guide protrusion 115 or the protrusion insertion groove 47 is disposed on/in the housing 110 is referred to as a second guide part.

Thus, the housing 110 can be smoothly withdrawn or inserted in the front and rear directions of the door 20 without moving the housing 110 in a vertical direction.

The connection passage 510 includes a first passage 512 through which the water supplied into the receiving part 112 of the housing 110 flows, a second passage through which the water passing through the holes 113*a* of the housing 110 flows, and a receiving chamber 46 connecting the first passage 512 to the second passage 514. The storage box 100 is positioned between the first passage 512 and the second passage 514 in a state where the storage box 100 is completely received in the receiving chamber 46.

That is, in this embodiment, when the storage box 100 is inserted into the dispenser 40, the receiving part 112 is disposed on the connection passage 510.

Thus, in a state where the receiving part 112 is disposed on the connection passage 510, when the valve 520 is opened, the water within the first passage 510 passes through the receiving part 112 to contain the fragrance or the taste contained in the materials. Thereafter, the water containing the fragrance or the taste passes through the holes 113*a* and the second passage 514 and is discharged to the outside of the dispenser 40.

Hereinafter, an operation of the dispenser will be described.

In order to dispense the water adding the specific fragrance or the taste, the user grasps the handle 114, and then, the user pulls the storage box 100 in a front direction of the dispenser 40. Then, the storage box 100 is withdrawn in the front direction of the dispenser 40 due to an interaction between the guide protrusion 115 and the protrusion insertion groove 47.

A specific material M is received into the receiving part 112. The storage box 100 is inserted into the receiving chamber 46 of the dispenser 40. The user can manipulate the input part 43 such that the specific material M received into the receiving part 112 at present is displayed on the display part 42.

The user manipulates the manipulation lever 44. When the valve 520 is opened, the water within the water tank 50 flows into the first passage 512. The water within the first passage 512 contains the fragrance or the taste while the water passes through the receiving part 112. Thereafter, the water is dispensed to the outside of the dispenser 40 through the holes 113*a* and the second passage 514.

In order to replace or remove the specific material M received in the receiving part 112, the storage box 100 is pulled toward the front direction of the dispenser 40.

According to this embodiment, since pure water or the water adding the fragrance or the taste can be dispensed according to user's selection, user's taste can be satisfied.

Also, since the storage box 100 for receiving the specific material M containing the fragrance or the taste is insertably or withdrawably installed in the dispenser 40, the specific material M can be easily received into the storage box 100, or removed or replaced.

Figure 5:
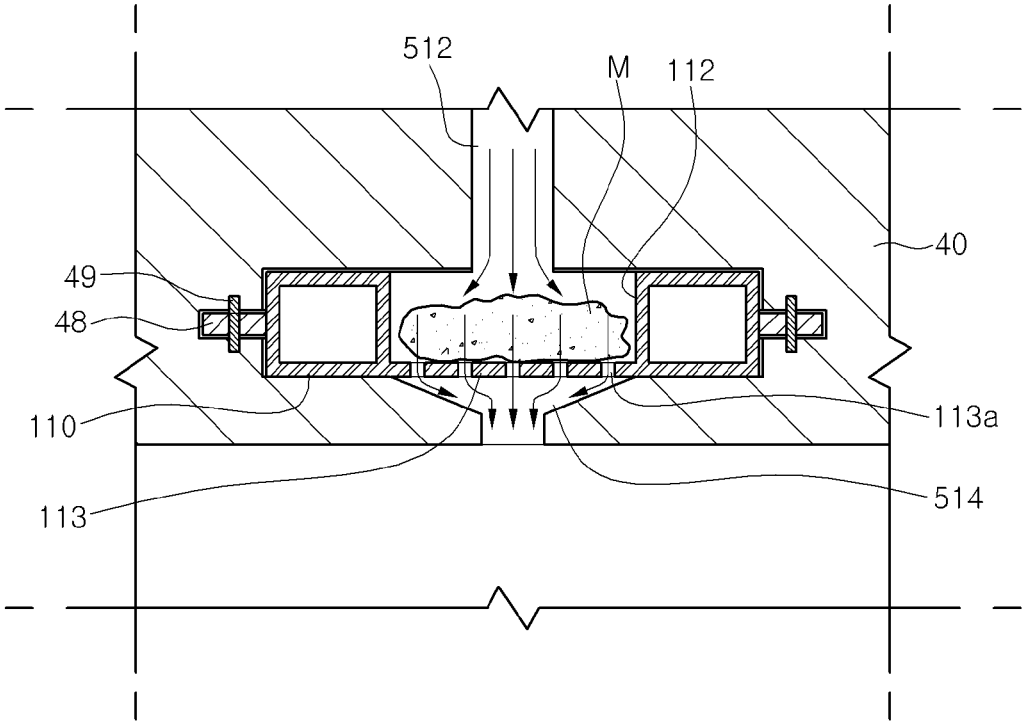
FIG. 5 is a cross-sectional view taken along line A-A of FIG. 2 according to a second embodiment.

FIG. 5 is a cross-sectional view taken along line A-A of FIG. 2 according to a second embodiment.

This embodiment is the same as the first embodiment except for a structure of a withdrawable guide of a storage box. Therefore, only characteristics parts of this embodiment will be described below.

Referring to FIG. 5, a dispenser 40 includes a guide part 48 rotating with respect to a shaft 49 to smoothly slide in front and rear directions of a storage box. For example, the guide part 48 may include a roller.

The guide part 48 may be disposed on both sides of the storage box 100.

Also, a plurality of guide parts 48 may be provided in insertion and withdrawal directions (front and rear directions) of the storage box 100.

According to this embodiment, the storage box 100 can further smoothly slide.

Although the guide part 48 is provided on a lateral side of the storage box 100 in this embodiment, the present disclosure is not limited thereto. For example, the guide part 48 may be provided on an upper side or lower side of the storage box 100, and may be provided on at least two portions of the lateral side, the upper side, and the lower side.

Figure 6:
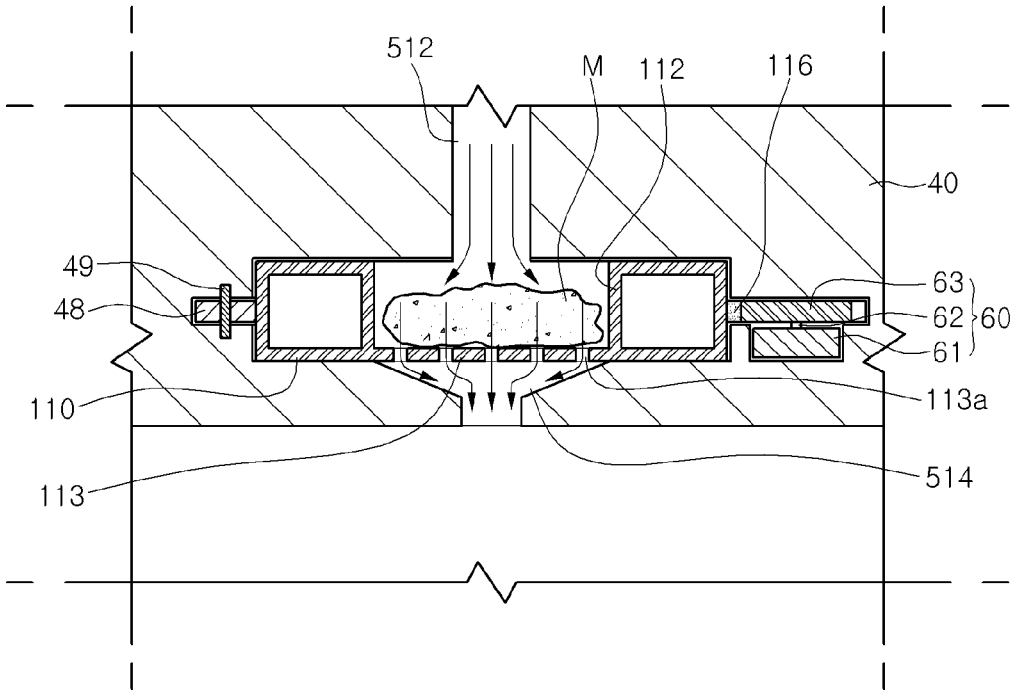
FIG. 6 is a cross-sectional view taken along line A-A of FIG. 2 according to a third embodiment.

FIG. 6 is a cross-sectional view taken along line A-A of FIG. 2 according to a third embodiment.

This embodiment is the same as the first or second embodiment except for an automatic movement of a storage box. Therefore, only characteristics parts of this embodiment will be described below.

Referring to FIG. 6, a drive unit 60 for automatically moving a storage box 100 is provided on a side of the storage box 100.

In detail, the drive unit 60 includes a motor 61 generating a driving force and a drive gear 63 coupled to a shaft 62 of the motor 61.

A driven gear 116 engaged with the drive gear 63 is disposed on a side surface of the storage box 100. Here, a pinion gear may be used as the drive gear 63, and a rack gear may be used as the driven gear 116. The drive gear 63 performs a rotary motion, and the driven gear 116 converts the rotary motion of the drive gear 63 into a translation motion.

Thus, the storage box 100 slides in front and rear directions of a door 20 due to the rotation of the motor 61 and the drive gear 63. In order to move the storage box 100 in the front and rear directions of the door 20, a motor that can forwardly or reversely rotate may be used as the motor 61.

A guide part 48 for guiding insertion or withdrawal of the storage box 100 may be provided in a dispenser 40. The guide part 48 may have the same structure as that of, for example, the second embodiment. On the other hand, a guide part (the guide protrusion and the protrusion insertion groove) having the same structure as that of the first embodiment may be provided in the dispenser 40 and the storage box 100.

An operation signal of the motor 61 may be inputted by selecting a storage box button constituting the input part (See reference numeral 43 of FIG. 2).

In detail, the input part (See reference numeral 43 of FIG. 2) may include the storage box button for inserting or withdrawing the storage box 100. Thus, when the storage box button is pushed at once, the motor 61 rotates in one direction, and thus, the storage box 100 is withdrawn from the dispenser 40. When the storage box button is pushed again, the motor 61 rotates in the other direction, and thus, the storage box 100 is inserted into the dispenser 40.

Alternatively, the input part (See reference numeral 43 of FIG. 2) may include a withdrawal button and an insertion button. Thus, when the withdrawal button is pushed, the motor 61 rotates in the one direction, and thus, the storage box 100 is withdrawn from the dispenser 40. On the other hand, when the insertion button is pushed, the motor 61 rotates in the other direction, and thus, the storage box 100 is inserted into the dispenser 40.

According to this embodiment, since the storage box 100 is automatically withdrawn or inserted by the manipulation of the input part (See reference numeral 43 of FIG. 2), user's convenience can be improved.

Here, the motor is used as not the drive unit but an actuator that can perform the translation motion in front and rear directions. For example, in this case, the actuator may be disposed in a rear direction of a back surface of the storage box 100.

Figure 7:
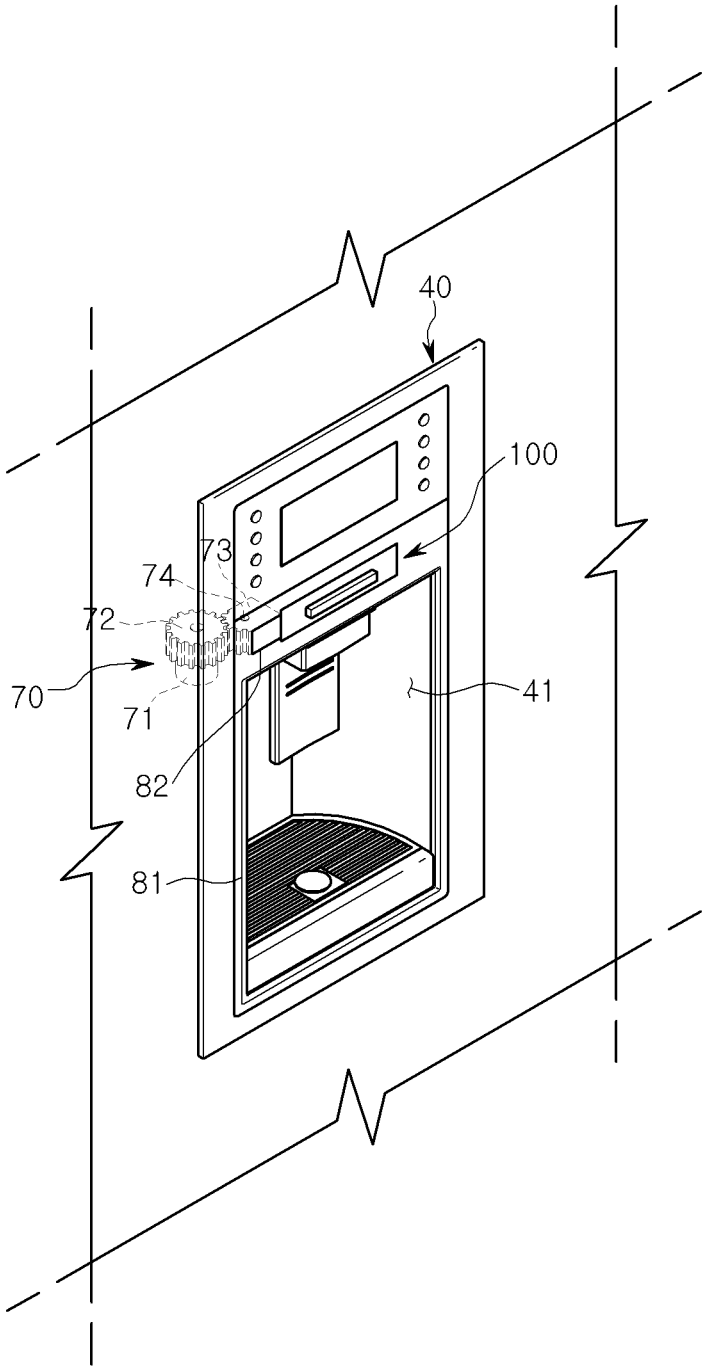
FIG. 7 is a perspective view illustrating a structure of a dispenser according to a fourth embodiment.

FIG. 7 is a perspective view illustrating a structure of a dispenser according to a fourth embodiment.

This embodiment is the same as the first embodiment except for a type of an insertion or withdrawal of the storage box. Therefore, only characteristics parts of this embodiment will be described below.

Referring to FIG. 7, a drive unit 70 for rotating a storage box 100 is provided on a lateral side of the storage box 100. The drive unit 70 includes a motor 71 and a drive gear 72 coupled to the motor 71.

A driven gear 73 engaged with the drive gear 72 and transmitting a rotation force transmitted from the drive gear 72 into the storage box 100 is disposed on a side of the storage box 100.

A receiving groove 82 for receiving the driven gear 73 is disposed in a sidewall 81 defining a receiving part 41 of a dispenser 40. When the driven gear 73 is inserted into the receiving groove 82, the driven gear is engaged with the drive gear 72. Protrusions 74 for providing a rotation shaft of the driven gear 73 are disposed on top and bottom surfaces of the driven gear 73. Protrusion insertion grooves (not shown) in which the protrusions 74 are inserted are disposed in upper and lower sides of the receiving groove 82.

A lateral surface of the storage box 100 may be rounded to rotatingly withdraw the storage box 100.

Thus, when the motor 71 rotates in one direction, the drive gear 72 rotates in the one direction. When the drive gear 72 rotates in the one direction, the driven gear 73 rotates in the other direction. Thus, the storage box 100 rotates by the rotation of the driven gear 73 to withdraw the dispenser 40 in a front direction.

Figure 8:
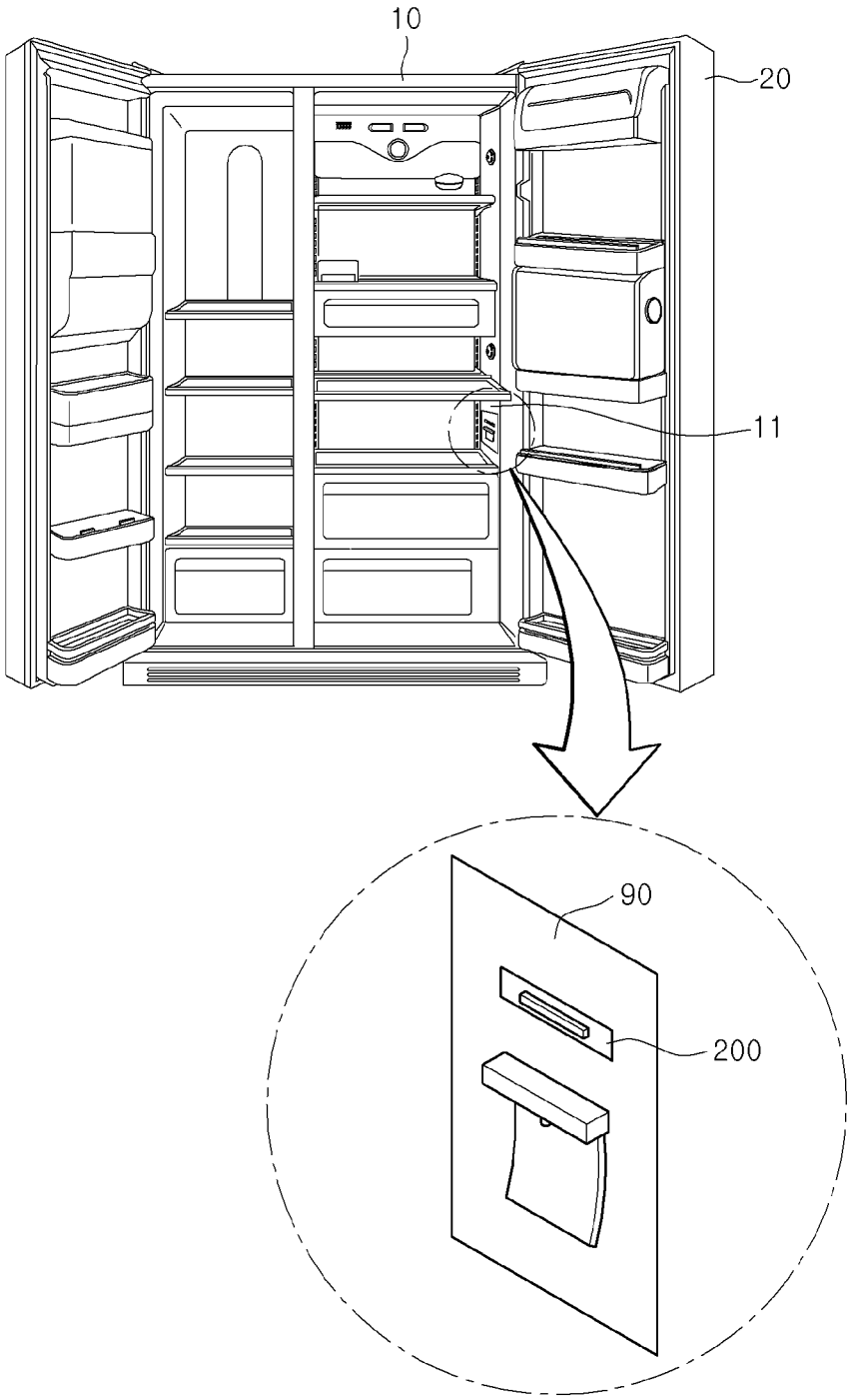
FIG. 8 is a perspective view of a refrigerator according to a fifth embodiment.

FIG. 8 is a perspective view of a refrigerator according to a fifth embodiment.

This embodiment is the same as the previous embodiments except for positions of a dispenser and a storage box. Therefore, only characteristics parts of this embodiment will be described below.

Referring to FIG. 8, a dispenser 90 and a storage box 200 according to this embodiment are provided in a main body 10 of a refrigerator. For example, the dispenser 90 and the storage box 200 may be disposed in a sidewall 11 defining a storage compartment. Thus, a user may open a door 20 to use the dispenser 90 or insert or withdraw the storage box 200.

What is claimed is:

1. A refrigerator, comprising:

a body having a door; and a dispenser disposed in the refrigerator, the dispenser comprising:

a receiving part configured to receive a container;

a passage leading to the receiving part and configured to deliver water;

a receiving chamber located above the receiving part and in communication with the passage;

a storage box movable inwardly and outwardly from the receiving chamber;

a first guide part in the receiving chamber;

a second guide part on the storage box mating with the first guide part;

a motor;

a drive gear connected to the motor; and a driven gear meshing with the drive gear, the driven gear connected to the storage box, wherein water flowing through the passage passes through the storage box.

2. The refrigerator of claim 1, wherein the first guide part is a protrusion and the second guide part is a groove.

3. The refrigerator of claim 1, wherein the first guide part is a groove and the second guide part is a protrusion.

4. The refrigerator of claim 1, wherein the first guide part is a groove and the second guide part is at least one roller extending from each side of the storage box.

5. The refrigerator of claim 1, wherein the driven gear is a rack gear.

6. The refrigerator of claim 1, wherein the storage box comprises:

a housing;

a compartment formed in the housing and configured to receive flavorings; and a compartment bottom wall having apertures allowing the passage of liquid therethrough.

7. The refrigerator of claim 1, wherein the dispenser is located in the door.

8. The refrigerator of claim 1, wherein the body has side walls with an inner surface and an outer surface, the dispenser being located on the inner surface on one of the side walls.

9. A refrigerator, comprising:

a body having a door; and a dispenser disposed in the refrigerator, the dispenser comprising:

a receiving part configured to receive a container;

a passage leading to the receiving part and configured to deliver water;

a chamber located above the receiving part and in communication with the passage, the chamber configured to receive beverage making material;

a storage box movable inwardly and outwardly from the chamber a motor;

a drive gear connected to the motor; and a driven gear meshing with the drive gear, the driven gear connected to the storage box, wherein water flowing through the passage passes through the chamber and is combined with the beverage making material.

10. The refrigerator of claim 9, wherein the dispenser is located in the door.

11. The refrigerator of claim 9, wherein the body has side walls, each side wall having an inner surface and an outer surface, the dispenser being located on the inner surface of one of the side walls.

12. The refrigerator of claim 9, further comprising:

a first guide part in the chamber; and a second guide part on the storage box mating with the first guide part.

13. The refrigerator of claim 12, wherein the first guide part is a protrusion and the second guide part is a groove.

14. The refrigerator of claim 12, wherein the first guide part is a groove and the second guide part is a protrusion.

15. The refrigerator of claim 12, wherein the first guide part is a groove and the second guide part is at least one roller extending from each side of the storage box.

16. The refrigerator of claim 9, wherein the storage box comprises:

a housing;

a compartment formed in the housing; and a compartment bottom wall having apertures allowing the passage of liquid therethrough.

* * * * *